US006363853B1

(12) United States Patent
Rohr

(10) Patent No.: US 6,363,853 B1
(45) Date of Patent: Apr. 2, 2002

(54) ELECTRICALLY INITIATED DISTRIBUTED IGNITER

(75) Inventor: Paul R. Rohr, Clifton, VA (US)

(73) Assignee: APTI, Inc., Washington, DC (US)

( * ) Notice: Subject to any disclaimer, the term of this patent is extended or adjusted under 35 U.S.C. 154(b) by 0 days.

(21) Appl. No.: 09/398,391

(22) Filed: Sep. 17, 1999

(51) Int. Cl.[7] ..... F42B 3/10; F42B 5/08; F42C 19/12

(52) U.S. Cl. ..... 102/202.7; 102/202.8; 102/202.11; 102/217; 102/472

(58) Field of Search ..... 102/202.7, 202.8, 102/202.11, 217, 338, 345, 472

(56) References Cited

U.S. PATENT DOCUMENTS

| | | | | | |
|---|---|---|---|---|---|
| 2,506,229 | A | * | 5/1950 | Lowe et al. | 102/202.11 |
| 3,618,519 | A | * | 11/1971 | Griffith | 102/217 |
| 5,016,537 | A | * | 5/1991 | Pinson | 102/472 X |
| 5,263,416 | A | * | 11/1993 | Amundson | 102/217 X |
| 5,945,623 | A | * | 8/1999 | Goldstein et al. | 102/472 X |
| 6,070,531 | A | * | 6/2000 | Hanson et al. | 102/202.7 X |
| 6,105,503 | A | * | 8/2000 | Baginski | 102/202.7 X |
| 6,119,599 | A | * | 9/2000 | Johnson et al. | 102/472 |
| 6,129,976 | A | * | 10/2000 | Mizushima et al. | 102/202.7 X |

FOREIGN PATENT DOCUMENTS

| | | | | |
|---|---|---|---|---|
| EP | 488863 | * | 6/1992 | 102/202.7 |
| FR | 2704944 | * | 11/1994 | 102/202.7 |

OTHER PUBLICATIONS

Cutting et al, *Insensitive Fuze Train for High Explosives*, W–7405–Eng–48, Jun. 11, 1992, pp. 1–15 (copy in 102/202.7).*

* cited by examiner

*Primary Examiner*—Peter A. Nelson
(74) *Attorney, Agent, or Firm*—Rossi & Associates

(57) ABSTRACT

An electrically initiated distributed igniter (EIDI) system combines most of the advantages of conventional pyrotechnic igniters with those of ETC planar igniters without the disadvantages of either. The EIDI system lends itself to precise timing control of multiple electric circuits, embedded charge ignition, and other design advantages to be discussed here. The EIDI system utilizes discrete igniter pads which require only a few millijoules of energy each and are quite small in size, about 3 mm in diameter. As a result, the igniters can be used in very large numbers to give good spatial distribution, even for smaller 25 to 40 mm diameter gun charge designs. Energy requirements are so minimal that small disposable firing capacitors and semi-conductor switches can be pre-packaged inside the casing along with the propellant and igniters. This allows multiple igniter firing circuits, used to control the explosion of the main propellant, to be reliably packaged with the charge and firing information, which is energized via a single breech connection. Also related to the low energy requirements of this concept, power requirements are small enough to be delivered by the same 24 v dc firing circuit which is already in place on most modem gun systems.

6 Claims, 5 Drawing Sheets

ELECTRICALLY INITIATED DISTRIBUTED IGNITER

FIELD OF THE INVENTION

The invention relates in general to an electrically initiated igniter system to ignite the main propellant in the chamber of a gun. More specifically, the invention provides a electrically initiated distributed igniter that includes an array of igniter pads placed in contact with the main propellant, wherein the igniter pads utilize an integrated oxidizer layer.

BACKGROUND OF THE INVENTION

Utilizing pyrotechnic igniters and electro-thermal chemical (ETC) planar igniters to ignite the main propellant in the chamber of a large diameter gun is well known in the art. Two of the problems inherent to these conventional igniter systems are delayed ignition of the main propellant and large electrical energy requirements to fire the igniters.

Delayed ignition is a problem during a base ignition of a cartridge with a high loading density is in excess of 1 g/cc. Since the pressure in the gun chamber due to the igniter is rapidly equilibrated, propellant flame spread is the primary ignition mechanism for much of the charge surface. Under these conditions, this is a relatively slow and incomplete process resulting in ignition delays, particularly from one end of the charge to the other.

Very large diameter charges, such as employed in the Navy's 5-inch Mk-45 gun, also experience the delayed ignition problem. The Mk-45 utilizes a center core igniter and the main propellant charge is thirty-two inches long. Due to its length, this igniter induces ignition time delays in excess of 0.5 ms between the breech and projectile end of the charge. This delay is due to a combination of the detonation cord run up of fifteen inches within the igniter itself and the additional fifteen inches or so of axial flame spread that must occur before the propellant at the front of the thirty-two inch long charge is ignited.

In order to overcome the problem of delayed ignition, it would be desirable to provide a plurality of igniters distributed throughout the charge. Conventional ETC igniters, however, use between 0.25 kJ and 1 kJ of electrical energy per igniter because that energy must drive the main propellant directly, partly through a strongly radiating about 1 eV arc and partly through the convection energy transport of metal/insulator vapor to the propellant. Accordingly, the number of igniters that can be provided is limited due to the energy available in conventional 24 volt firing circuits.

In view of the above, it is an object of the invention to provide an improved igniter system for the main propellant of guns that avoids problems associated with delayed ignition while having a low ignition energy requirement that can be met by conventional firing circuits.

SUMMARY OF THE INVENTION

The present invention provides a electrically initiated distributed igniter (EIDI) system that combines most of the advantages of conventional pyrotechnic igniters with those of ETC planar igniters without the disadvantages of either. The EIDI system lends itself to precise timing control of multiple electric circuits, embedded charge ignition, and other design advantages to be discussed here.

A typical EIDI design in accordance with the invention for a large diameter gun might distribute the energy of a conventional base igniter over 1,000 discrete locations and initiate them all with $1/10{,}000$ the ignition energy that current ETC systems require. The EIDI system utilizes discrete igniter pads that require only a few millijoules of energy each and are quite small in size, about 3 mm in diameter. As a result, the igniter pads can be used in very large numbers to give good spatial distribution, even for smaller 25 to 40 mm diameter gun charge designs. Energy requirements are so minimal that small disposable firing capacitors and semiconductor switches can be pre-packaged inside the casing along with the propellant and igniters. This allows multiple igniter firing circuits, used to control the explosion of the main propellant, to be reliably packaged with the charge and firing information, which is energized via a single breech connection. Also related to the low energy requirements of this concept, power requirements are small enough to be delivered by the same 24 v dc firing circuit which is already in place on most modern gun systems.

The basic differences between conventional ETC igniters and EIDI are the total amount of electrical energy required for operation, and the practical limit on the number of individual ignition pads employed. The EIDI system utilizes a primary igniter propellant stage and a secondary main propellant stage. Because an EIDI igniter pad utilizes a primary propellant stage, the energy requirements for ignition of the igniter pade are extremely low, between 0.1 and 10 mJ per igniter pad. In contrast, conventional ETC igniters use between 0.25 kJ and 1 kJ of electrical energy per igniter pad because that energy must drive the main propellant directly, partly through a strongly radiating about 1 eV arc and partly through the convection energy transported to metal/insulator vapor to the propellant.

The EIDI offers several advantages not available with ETC designs. Because the energy requirements are so very small, much of the electrical circuitry can be pre-packaged inside the casing. The firing circuits are disposable and their components include capacitors, switches, and igniter pads. This minimizes external electrical problems by confining them to a power supply and a trigger signal. It also allows an additional degree of flexibility inside the casing by making use of multiple firing circuits to control and modify gas generation rate according to external inputs, for example temperature, projectile weight, and range.

BRIEF DESCRIPTION OF THE DRAWINGS

The invention will now be described with reference to certain preferred embodiments thereof and the accompanying drawings, wherein.

DETAILED DESCRIPTION OF THE PREFERRED EMBODIMENTS

Figure 1:
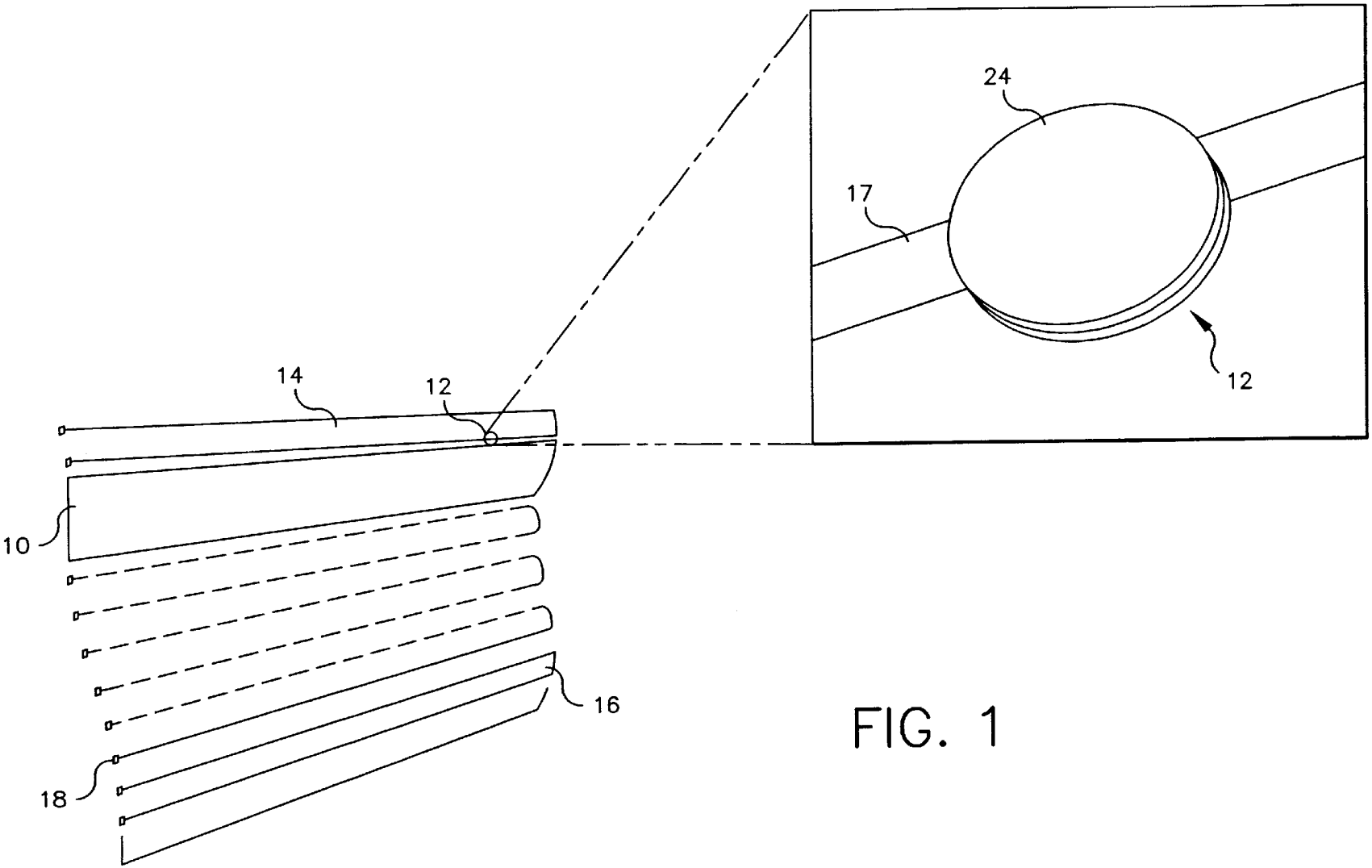
FIG. 1 illustrates an igniter in accordance with the present invention that includes a flexible insulator sheet and an array of igniter pads.

FIG. 1 illustrates an EIDI igniter 10 in accordance with the invention. The igniter 10 includes an array of igniter pads 12 arranged on a flexible insulator sheet 14. In the illustrated example, the igniter pads 12 are arranged in parallel rows and are connected by a series of loop circuits 16, each of which is composed of two parallel rows of igniter pads 12 electrically coupled together in series by a conductor 17 and oriented lengthwise along the insulator sheet 14. A pair of electrical terminals 18, located at the same end of the flexible igniter sheet 14, are provided for each of the loop circuits 16. The electrical terminals 18 are connected to a firing circuit (not shown).

Figure 2:
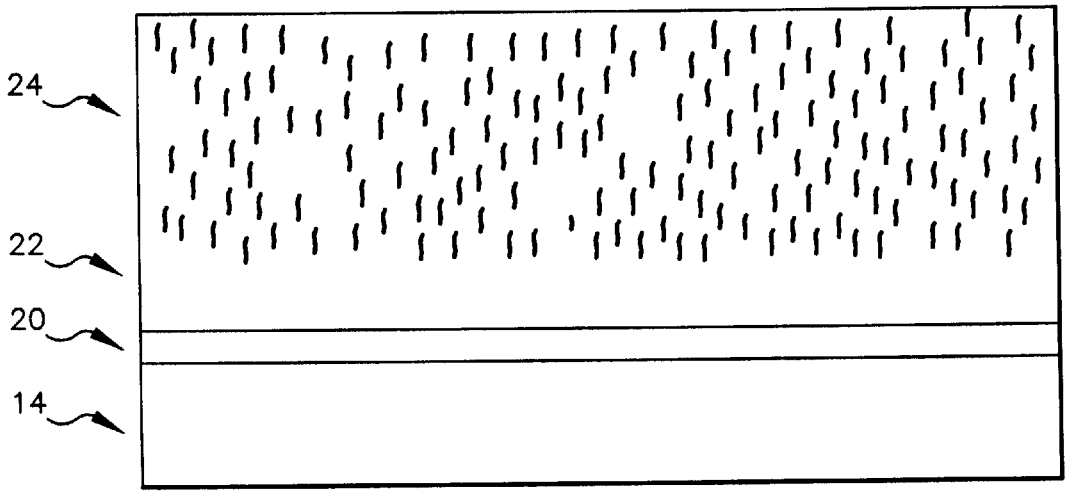
FIG. 2 is a cross-sectional view of an igniter pad utilized in the igniter illustrated in FIG. 1.
Figure 3:
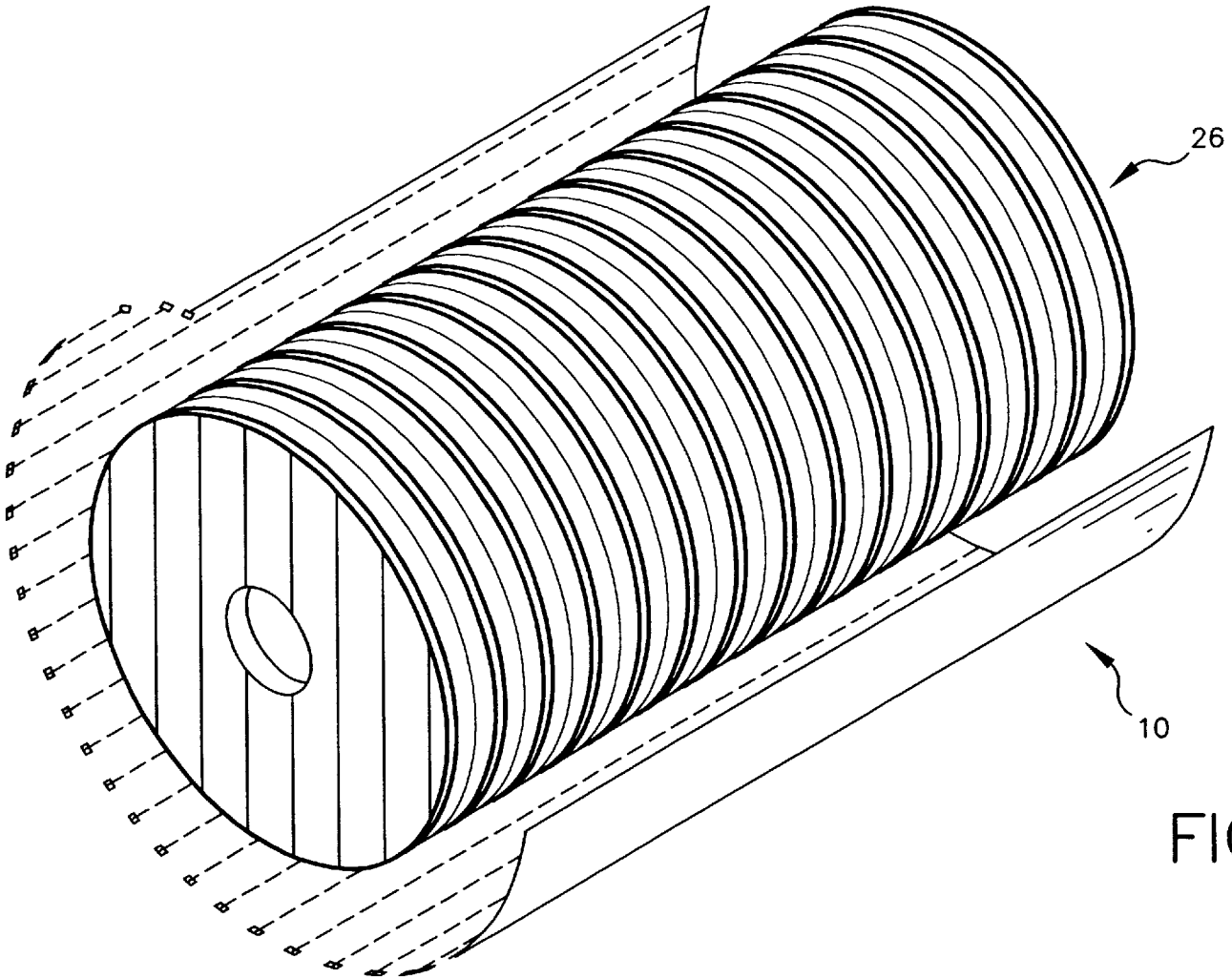
FIG. 3 is a perspective view of a flexible igniter sheet wrapped around a propellant including a plurality of layered disks.

As illustrated in FIG. 2, each igniter pad 12 includes a metal foil layer 20 overlaid by an oxidizer layer 22, which in turn is overlaid by a primary igniter propellant 24. The metal foil layer 20 is supported by the insulator sheet 14. The EIDI igniter 10 is placed in contact with a secondary main propellant of a charge such that the primary igniter propellant 24 is in direct contact with the secondary main propellant. In a peripheral configuration embodiment illustrated in FIG. 3, the EIDI igniter 10 is wrapped around the periphery of a plurality of layered secondary main propellant discs 26.

The EIDI has two ignition stages, the primary igniter propellant stage and the secondary main propellant stage. When the metal foil layer 20 is energized by an electrical firing circuit connected to the electrical terminals 18, it reacts with the oxidizer layer 22 and activates the primary igniter propellant 24. The primary igniter propellant 24 is present in a controlled quantity in the igniter pad 12, and as such can be chosen by design to deflagrate or detonate depending upon the desired speed and other design parameters.

The igniter pads 12 are preferably fabricated by silk screening or vapor depositing the three layers, i.e. the metal foil layer 20, the oxidizer layer 22, and the primary igniter propellant 24, directly on the insulator sheet 14 and in contact with the conductor 17 of the loop circuits 16. In one preferred embodiment of the present invention, the metal foil layer 20 is an aluminum foil vacuum deposited 0.01 to 1 m thick onto the insulator sheet 14 and overlaid by the oxidizer layer 22, such as ammonium nitrate, of similar thickness. The goal is to maximize the pre-reaction contact surface and minimize reaction mass to obtain the fastest reaction speed. The combination of gas generated and thermal energy produced must be consistent with the initiation conditions of the primary igniter propellant layer placed in direct contact with the secondary main propelling charge. Reaction temperatures of metal/oxidizer combinations as well as energy outputs of their chemical reactions directly relate to the amount of electrical energy required to energize the primary igniter reaction. In addition to these considerations, the speed of these micro-reactions must be maintained.

Figure 4:
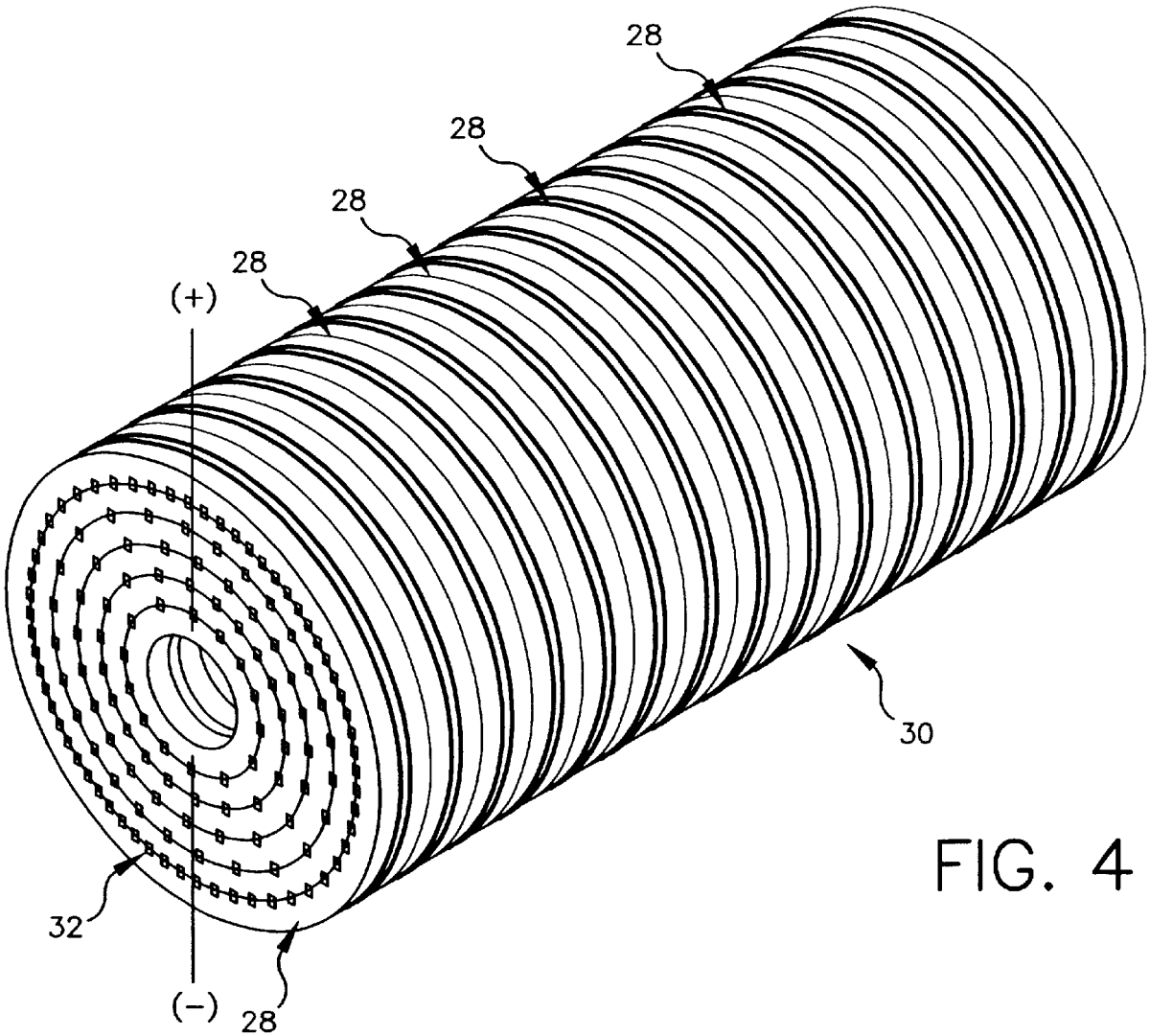
FIG. 4 is a perspective view of monolithic configuration charge in accordance with the invention.

The insulator sheet 14 of the EIDI igniter 10 is preferably formed from a flexible material. However, different configurations are possible in which the insulator sheet 14 may be rigid such as would be desired for a center-core geometry embodiment shown in FIG. 4. In FIG. 4 a disk shaped center core EIDI igniter 28 is installed on a cylindrical monolithic block propellant charge 30, which is composed of alternating layered disks of propellant with different combustion properties. In this embodiment, the igniter pads 12 are arranged in concentric ring shaped series circuits 32. A plurality of the center core EIDI igniters 28 may be distributed through the charge 30.

Figure 5:
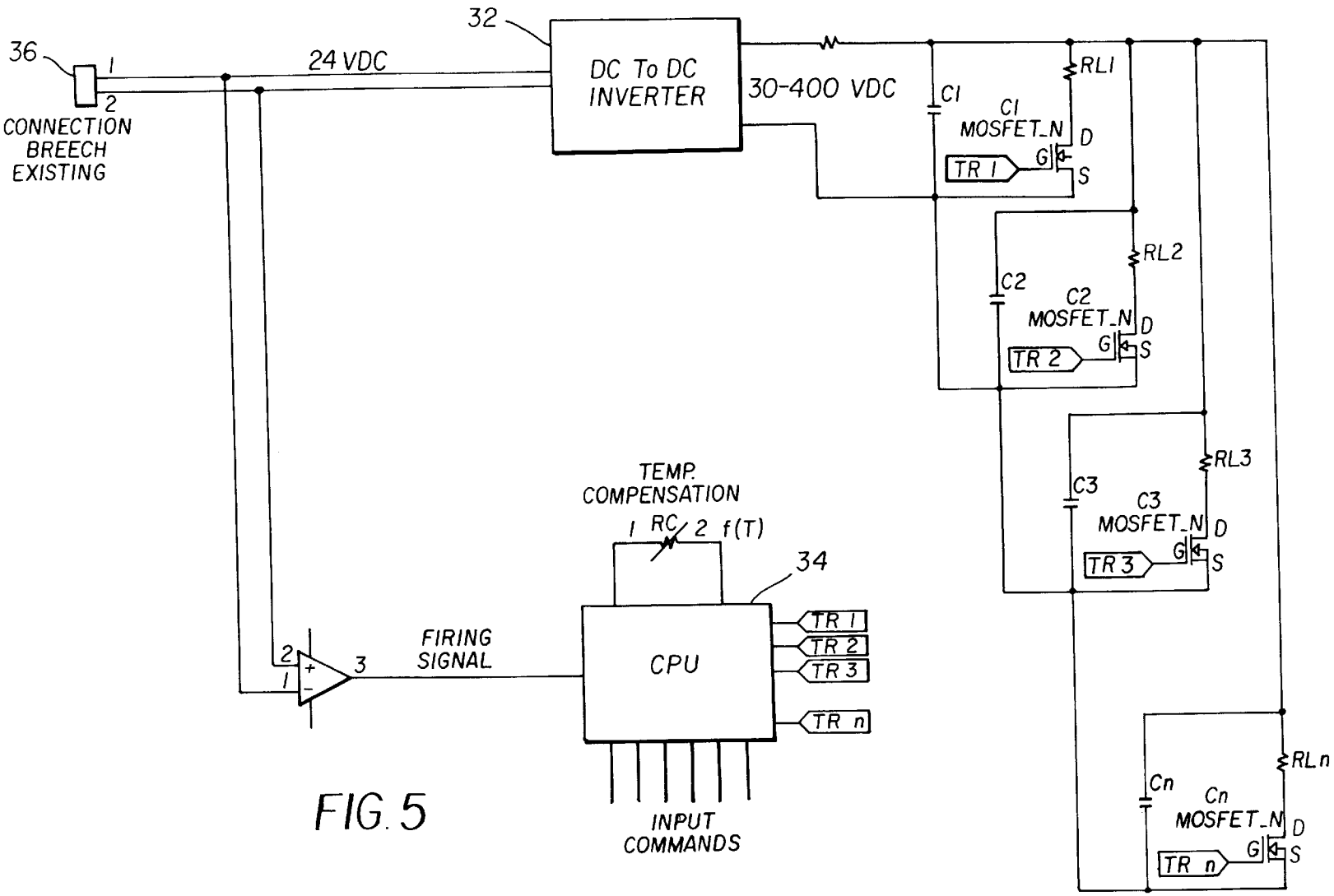
FIG. 5 is a schematic diagram of an electrical firing circuit in accordance with a preferred embodiment of the invention.

A preferred firing circuit is illustrated in FIG. 5. The firing circuit includes a DC to CD converter 32 and CPU 34 that are coupled to a conventional breech connection 36. The ignition process begins with the charging of firing capacitors (C1, C2, C3 . . . Cn), sized from 0.1 to 10 $\mu$f, that are coupled to the DC to DC inverter 32. The firing capacitors are then selectively switched across resistive loads (RL1, RL2, RL3 . . . R1n), namely the series circuits containing the igniter pads 12, by a semiconductor switching device such as a SCR, FET, or gate controlled switch (in the illustrated example Q1, Q2, Q3 . . . Qn) under control of the CPU 34, which can be programmed to provide any desired firing sequence or timing. The components of the firing circuit are preferably embedded within the layered disk (either between disks, in a central opening or on the insulator sheet 14) so that the charge is self-contained and can be utilized in conventional guns without requiring modifications. The energy applied by the ignition circuit may either detonate the metal foil 20 to initiate a small amount of shock sensitive explosive directly or simply deflagrate the metal foil 20 to start a chemical reaction that thermally initiates the primary igniter propellant 24. The difference between these two concepts is that detonating the metal foil 20 requires about 30 times the energy required to deflagrate the metal foil 20.

The secondary stage of ignition involves the transport interactions between the primary igniter propellant and the secondary main propellant. For initial design purposes it will be assumed that the EIDI energy requirement is the same as a comparable conventional or ETI igniter would require. The number of igniter pads depends primarily upon size, charge geometry, and igniter control requirements—large guns such as the US. Army's 120 mm, M-256 with temperature control may use 1,000 or more igniter pads.

The following example depicts design calculations for an EIDI system for a US Army, M-256 gun. Parameters such as the sizing of components, required igniter electrical energy, and capacitor charge voltage for the peripheral igniter sheet depicted in FIG. 1 may be calculated as follows:

Design Example—EIDI igniter for US Army, M-256 gun:

(Sizing the elements/ components)

Propellant: $NH_4NO_3 + 2Al \rightarrow Al_2O_3 + 2H_2 + N_2$

Mole Wt: 80 g + 54 g → 134 g reactants

Energy: $NH_4NO_3 \rightarrow \frac{1}{2}O_2 + 2H_2O + N_2 + 160\text{ kJ}$ $$\frac{1}{3}(2\,Al + 3/2\,O_2) \rightarrow \frac{1}{3}Al_2O_3 + 530\text{ kJ}$$

$$\frac{2}{3}(2\,Al + 3\,H_2O) \rightarrow \frac{2}{3}Al_2O_3 + 2\,H_2 + 530\text{ kJ.}$$

$$E_{tot} = 160 + 530 + 530 = 1220\text{ kJ}$$

$$\varepsilon = 1220\text{ kJ}/134\text{ g.} = 9.1\text{ kJ/g.}$$

For Igniter Energetics, Assume:

Need E≈100 kJ for proper secondary propellant ignition $$M_{ign} = \frac{E}{\varepsilon} = \frac{100\text{ kJ}}{9.1\text{ kJ/g}} = 11\text{ g}$$

Distribute among 1000 sites→11 mg/site

Exploding Film Resistance:

Size—assume 2 mm×0.1 mm×1 $\mu$m $$R_{pad} = \rho \frac{l}{A}, \quad \text{where } \rho = 2.688\ \mu\Omega/\text{cm for aluminum}$$

$$= 2.688 \times 10^{-6} \times \frac{0.2}{(0.01 \cdot 0.0001)}$$

$$= 0.538\ \Omega$$

Event Timing:

Assume t=RC=0.00001 sec. for electrical event $$C = \frac{0.00001}{0.538\ \Omega} = 18.6\ \mu\text{fd}$$

Electrical Energy Requirement-Two Cases, Exploding Film and Melting:

$$2.)\quad E_{melt} = mc_p \Delta T$$

$$= (0.00054)(0.226)(660) \times 10^{-3}$$

$$= 0.0805 \times 10^{-3}\ \text{cal}$$

$$= 0.3373\ \text{mJ}$$

Capacitor Charge Voltage:

$$E = \frac{1}{2}\ Ce^2,\ e = \sqrt{\frac{2E}{C}}$$

$$1.)\ e_{\exp} = (2 \times 10^{-2} / 2 \times 10^{-5})^{1/2} = 31.6\ \text{vdc.},$$

$$i_{\exp} = \frac{e_{\exp}}{R_{pad}} = 58.8\ \text{a}$$

$$2.)\ e_{melt} = (2 \times 0.34 \times 10^{-3} / 2 \times 10^{-5})^{1/2} = 5.83\ \text{vdc.},$$

$$i_{melt} = \frac{e_{melt}}{R_{pad}} = 10.8\ \text{a}$$

System Design, M-256 gun, (1000 igniter pads):

For 15 Parallel legs w. 66 pads ea., $$R_{tot} = \frac{66 \times 0.538}{15} = 2.3672\ \Omega$$

$$C_{tot} = \frac{\tau}{R_{Tot}} = \frac{0.00001}{2.3672} = 4.22\ \mu\text{fd.}$$

Charge voltage:

$$e = \left(\frac{2 \cdot E_{Tot}}{C}\right)^{\frac{1}{2}}$$

$$e_{\exp} = \left(\frac{2 \cdot 10}{4.22 \cdot 10^{-6}}\right)^{\frac{1}{2}} = 2175\ \text{vdc.},\quad I_{\exp} = 920\ \text{a.}$$

$$e_{melt} = \left(\frac{2 \cdot 0.34}{4.22 \cdot 10^{-6}}\right)^{\frac{1}{2}} = 377\ \text{vdc.},\quad I_{melt} = 160\ \text{a.}$$

Power@12 rnd/min:

$$P_{\exp} = \frac{E_{\exp}}{t} = 2\ \text{w. and}\ P_{melt} = \frac{E_{melt}}{t} = \frac{2}{3}\ \text{w.}$$

One of the significant virtues of EIDI is the speed of its ignition process, which takes place well within the induction time of the main propelling charge. This insures that the convection part of the energy transport process will be aided by the under expanded condition that exists between an igniter pad, reacting faster than the local decompression time and before the pressure wave it creates establishes equilibrium within the gun chamber. Under these conditions, igniter combustion products expand into the ambient pressure surroundings of the primary propellant charge before the secondary main propellant charge can react and offset this pressure gradient. In the case of the deflagrating foil, the igniter pads 12 must be deposited to a uniform thickness on the insulator sheet 14, and quickly but steady deflagrated by electrical energy before it can be transported away. This allows a fast chemical reaction of the deflagrated 1 m aluminum metal foil 20 in contact with a solid oxidizer 22 to proceed in 0.0001 sec. and that reaction to initiate the primary propellant 24 at the igniter pad 12 to react completely in 0.0005 sec. Delays longer than these start introducing timing uncertainties between igniter pads 12, which will introduce unwanted pressure waves. Further, timing variations between igniter pads 12 of more than about 0.0003 sec. will cause the secondary propellant to react with a great deal of non-uniformity, creating local hot spots, generating secondary combustion products, and interfering with the ignition process at other igniter pads. This will lead to an under-driven ignition situation, the worst case of which is a cook off.

In the case of the detonating foil directly driving the primary igniter propellant stage, the combination is predictably fast and reliable, unfortunately this configuration requires more electrical energy and can produce a harsh ignition source for the primary igniter propellant. Detonating foils use 30 times the energy of deflagrating foils and are predictably fast and hot, e.g., 10 km/sec and 17,600 K plasma temperature. However, the EIDI concept using detonating foil would use four orders of magnitude less electrical energy the current ETC designs.

The invention has been described with reference to certain preferred embodiment(s) thereof. It will be understood, however, that modification and variations are possible within the scope of the appended claims. For example, the igniter pad may be utilized to directly detonate explosive charges instead of propellant charges. In such cases, the primary propellant layer may be employed or may be removed so that the oxidizer layer contacts the exposive. Still further, all igniter pads may be simultaneously fired or fired in a desired sequence.

What is claimed is:

1. A propellant charge including:

a propellant; and a flexible igniter wrapped around the propellant;

wherein the flexible igniter includes an insulator sheet and a plurality of igniter pads formed on the insulator sheet;

wherein the igniter pads comprise a metal foil layer formed on the insulator, an oxidizer layer formed on the metal foil layer; and an igniter propellant formed on the oxidizer layer; and wherein the igniter pads are arranged on the insulator sheet in a plurality of paired parallel rows, and wherein each paired parallel row of igniter pads is connected in series by an electrical loop circuit.

2. A propellant charge as claimed in claim 1, further comprising a firing circuit coupled to the electrical loop circuit.

3. A propellant charge comprising:

a plurality of layered propellant disks; and at least one igniter sheet in contact with at least one of the propellant disks;

wherein the igniter sheet includes a plurality of igniter pads; and wherein the igniter pads comprise a metal foil layer formed on the insulator sheet, an oxidizer layer formed on the metal foil layer; and an igniter propellant formed on the oxidizer layer.

4. A propellant charge as claimed in claim 2, wherein the igniter pads are arranged in a plurality of rings, wherein the igniter pads within a ring are electrically connected in series.

5. A propellant charge as claimed in claim 3, further comprising a firing circuit coupled to the igniter pads.

6. A propellant charge as claimed in claim 3, wherein a firing circuit is embedded within said disks.

* * * * *